US007185584B1

(12) United States Patent
Woods et al.

(10) Patent No.: US 7,185,584 B1
(45) Date of Patent: Mar. 6, 2007

(54) MODULAR LATERAL HEAT PRESS MACHINE

(76) Inventors: Daniel L. Woods, 11704 NE. 34th St., Bellevue, WA (US) 98005; Linda M. Woods, 11704 NE. 34th St., Bellevue, WA (US) 98005

( * ) Notice: Subject to any disclaimer, the term of this patent is extended or adjusted under 35 U.S.C. 154(b) by 0 days.

(21) Appl. No.: 11/178,208

(22) Filed: Jul. 8, 2005

(51) Int. Cl.
*B30B 1/04* (2006.01)
*B30B 15/34* (2006.01)

(52) U.S. Cl. ..... 100/320; 100/99; 100/224; 100/233; 100/292; 100/319; 100/326; 156/579; 156/583.1; 156/583.7; 38/24

(58) Field of Classification Search ..... 100/43, 100/92, 99, 301, 302, 315, 319, 320, 324, 100/325, 326, 214, 221, 224, 226, 233, 292, 100/293; 156/579, 583.1, 583.7, 583.8, 583.9; 38/22, 23, 24; 223/75, 78
See application file for complete search history.

(56) References Cited

U.S. PATENT DOCUMENTS

| | | | | |
|---|---|---|---|---|
| 2,029,104 A | * | 1/1936 | Johnson | 38/5 |
| 2,049,589 A | * | 8/1936 | Malott Jr. | 38/22 |
| 2,624,964 A | * | 1/1953 | Westwood | 38/22 |
| 2,656,625 A | * | 10/1953 | Stanley | 38/22 |
| 2,904,098 A | | 9/1959 | Maitzen | 154/1 |
| 3,035,510 A | | 5/1962 | Carpenter et al. | 100/93 |
| 4,004,503 A | | 1/1977 | Dwyer | 101/9 |
| 5,147,496 A | | 9/1992 | Hix | 156/583.8 |
| 5,252,171 A | | 10/1993 | Anderson et al. | 156/358 |
| 5,435,883 A | | 7/1995 | Myers | 156/583.9 |
| 5,705,026 A | | 1/1998 | Latter | 156/583.9 |
| 5,730,052 A | | 3/1998 | Mather | 101/129 |
| 5,908,000 A | | 6/1999 | Spychalla et al. | 101/487 |
| 6,058,834 A | | 5/2000 | Beckwith | 100/99 |
| 6,151,814 A | | 11/2000 | Raio et al. | 38/30 |
| 6,173,211 B1 | | 1/2001 | Williams et al. | 700/131 |

* cited by examiner

*Primary Examiner*—Lowell A. Larson
*Assistant Examiner*—Jimmy Nguyen
(74) *Attorney, Agent, or Firm*—Dean A. Craine

(57) ABSTRACT

A lightweight, portable lateral heat press machine that allows an operator to quickly and economically transfer graphic characters or images using an ink transfer paper process or a sublimation process, or vinyl onto the surface of a garment or an object. The device includes a vertical aligned sliding arm assembly perpendicularly aligned to a horizontally aligned chassis assembly. Attached to the chassis assembly is at least one workstation assembly and a console. The workstation assembly includes a pedestal with an exchangeable, horizontally aligned lower platen that may be selectively rotated and locked in portrait or landscape orientation and a height and pressure adjustment feature. The sliding arm assembly extends upward and forward and includes a heated, upper platen attached to a manually operated plunger. The console contains the controls for operating the heating element inside the upper platen and a timer. In a second embodiment, a second workstation assembly is provided which enables the operator to slide the arm assembly between workstations thereby enabling the operator to setup one workstation as the pressing procedure is being performed on the other.

28 Claims, 17 Drawing Sheets

MODULAR LATERAL HEAT PRESS MACHINE

BACKGROUND OF THE INVENTION

1. Field of the Invention

This invention relates to heat presses and, more particularly, to heat presses that are easy to use and expandable for greater workloads.

2. Description of the Related Art

Hobbyists and small businesses have a need for heat press machines for transferring graphic images or characters on to garments or similar substrates that are relatively inexpensive and easy to use. Ideally, such machines should be relatively compact, and capable of being easily setup and easily operated on a work support surface.

Heat presses are typically swing arm or clam-style presses that use an upper heat platen and lower substrate platen that are aligned, and pressed together over a garment or substrate when placed on the lower platen for the purpose of transferring graphic images or characters to the garment or substrate. It is common to exchange the type of heat press machine to accommodate different garments or substrates. Features on the press that allow the lower platens to be easily and quickly exchanged to maximize production are highly desirable.

The graphics and images are typically aligned in portrait or landscape orientation on garments or substrates. Presses that allow the operator to easily and quickly change the orientation of the platen to accommodate vertical or horizontal graphics or images on the garment or substrate to maximize production size requirements would also be highly desirable.

For many pressing projects, large quantities of garments or substrate articles are imprinted. Because the transfer process is permanent, a considerable effort and time is spent properly aligning the garment or substrate over the lower platen before pressing. Also, because the heat transfer process takes several seconds, a considerable amount of idle time is spent by the operator waiting for the heat transfer process to be completed. While heat presses with one set of upper and lower platens may be adequate for hobbyists or businesses with small imprinting projects, hobbyists or businesses with larger imprinting projects would find presses with multiple printing stations that allow the operator to setup one station while the heat transfer process is performed on the other station would be highly desirable.

Many businesses need heat presses that can be expanded to meet the growing needs of the business. Unfortunately, most heat presses available today are not expandable thereby forcing business owners to replace their small, fully functional heat presses with new, larger capacity heat presses or purchase a second or third machine like they already possess. Exchanging small heat presses for larger capacity heat presses is not only expensive but also inefficient because it requires operators to learn new press operations. Buying a second or third heat press identical to the first heat press also occupies more space and may require more than one person to simultaneously operate all of the heat presses.

What is needed is a compact, multipurpose heat press that is easy to learn, enables lower platens to be exchanged, allows pressing in both portrait and landscape orientations, and uses a modular design that can be easily expanded to increase its pressing capacity.

SUMMARY OF THE INVENTION

It is an object of the present invention to provide a portable, multipurpose, easy to use heat press.

It is another object of the present invention to provide such a heat press that enables the lower platen to be easily and quickly exchanged.

It is another object of the present invention to provide such a heat press that allows the upper and lower platens to be adjusted for imprinting in either portrait or landscape orientations.

It is a further object of the present invention to provide such a heat press that has a modular design that can be easily expanded to increase the press's production capacity.

These and other objects of the invention that will become apparent are met by the improved heat press disclosed herein that includes a vertically aligned sliding arm assembly designed to slide laterally in opposite directions over a compact chassis assembly. The sliding arm assembly is perpendicularly aligned with the chassis assembly's elongated body and designed to extend upward and over the elongated body when assembled. Attached to the upper portion of the sliding arm assembly is a vertical neck with a moveable plunger located therein. A handle is coupled to the plunger that manually moves the plunger up and down inside the vertical neck.

Attached to the lower end of the plunger is an upper platen assembly that includes a platen management plate, an insulation layer, and an upper heat platen. In the preferred embodiment, a rotation and locking means is provided that enables the upper platen assembly to easily rotate 90 degrees and lock in position over the end of the plunger thereby enabling the upper platen assembly to be placed in portrait or landscape orientations. Located in the upper platen is a heating element coupled to a control unit located in a central console attached to the chassis assembly.

The lower platen is supported by a workstation assembly attached and perpendicularly aligned on one end of the chassis assembly. The workstation assembly includes a workstation pedestal comprising a lower base, a forward extending strut member and an upper platform. The lower platen is supported by the upper platform which is cantilevered and extends forward from the elongated body so that garments and substrates may be easily 'over or under loaded' on the lower platen.

Disposed between the upper platform of the lower platen is a quick release locking plate that enables the lower platen to be easily rotated and locked in position between portrait and landscape orientations. The quick release locking plate also allows the lower platen to be exchanged with other lower platens designed to be used with other types of garments or substrates. The following four exchangeable lower platens are disclosed herein: a standard wide-style lower platen; a sleeve-style lower platen; a hat style lower platen; and a pocket-style lower platen. Because garments and substrates have different thickness, height adjustment means is also provided within the pedestal that allows the operator to control the height of the lower platen on the locking plate. In the preferred embodiment, a self-tensioning means is also provided between the upper platform and the lower platen that allows the lower platen to finely adjust its height for different types of garments and substrates.

Attached to the chassis assembly is a perpendicularly aligned, compact console that houses the main electrical components used to control the heating and timer circuits used in the press. In the preferred embodiment, the console is centrally located on the chassis assembly and within easy reach of the workstation assembly. When used with one workstation assembly, the console also helps to support the elongated body on a horizontal support surface. Conveniently mounted on the front surface of the console is a keypad with a plurality of keys used to operate the press. A power receptacle is also conveniently mounted on the rear surface of the console to supply electricity to other pieces of electrical equipment that may be used by the operator.

In the first embodiment, the press is described as having one workstation assembly located at one end of the chassis assembly. In a second embodiment, a second workstation pedestal is easily attached at the opposite end of the chassis assembly. When the second embodiment is used, the operator moves the sliding arm assembly over the chassis assembly between the two-workstation assemblies. As the sliding arm assembly is being used on one workstation assembly, the other workstation assembly can be setup.

A laser guided image alignment assembly is also provided that enables the worker to easily and consistently align the image to be imprinted on garments or substrates placed over the lower platen on each heat press thus making the pressing process faster and more accurate.

DESCRIPTION OF THE PREFERRED EMBODIMENT(S)

Figure 20:
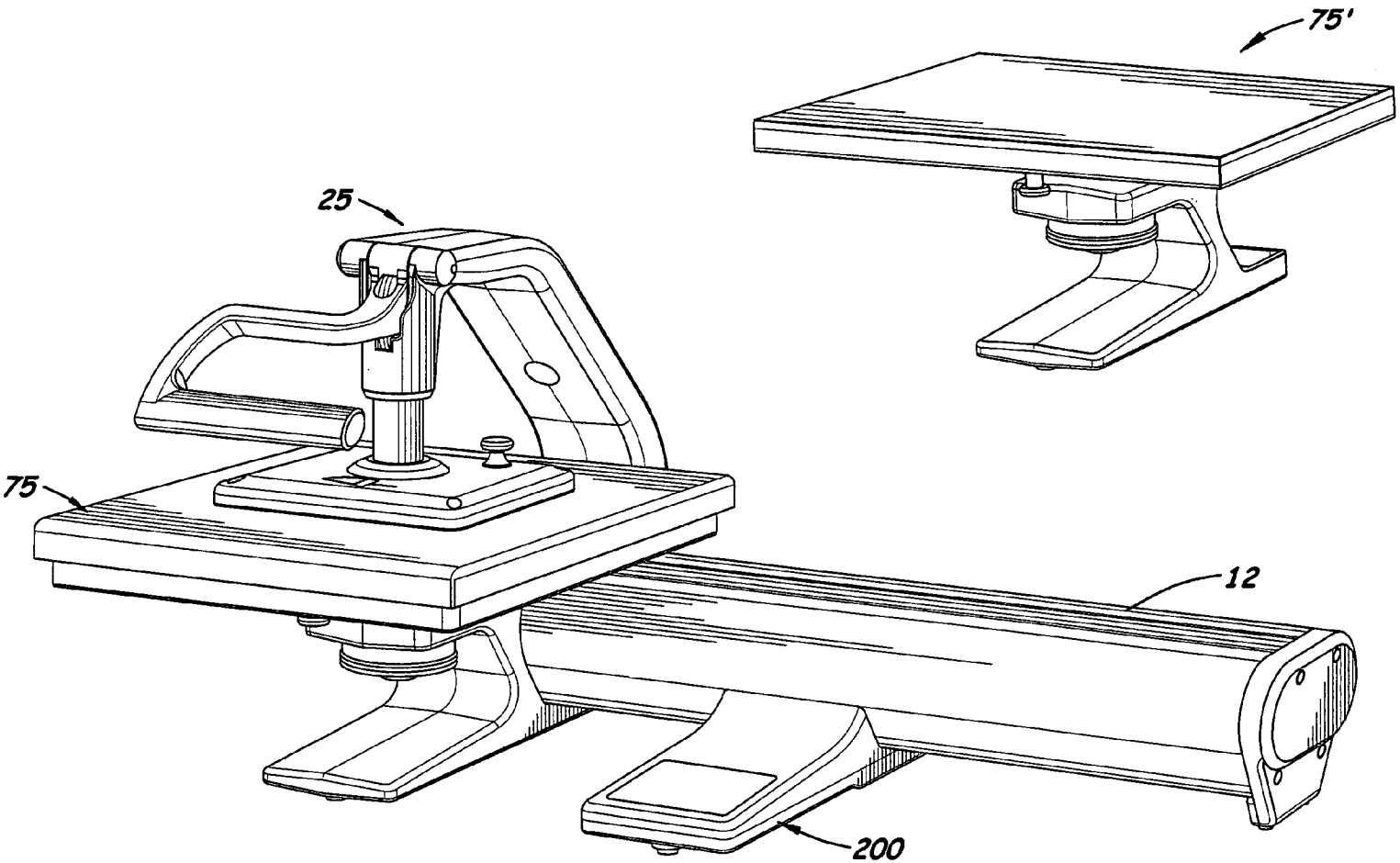
FIG. 20 is a perspective view of the lateral heat press machine shown in FIGS. 1–4 with a second workstation pedestal being perpendicularly aligned and attached at the opposite end of the chassis assembly.
Figure 21:
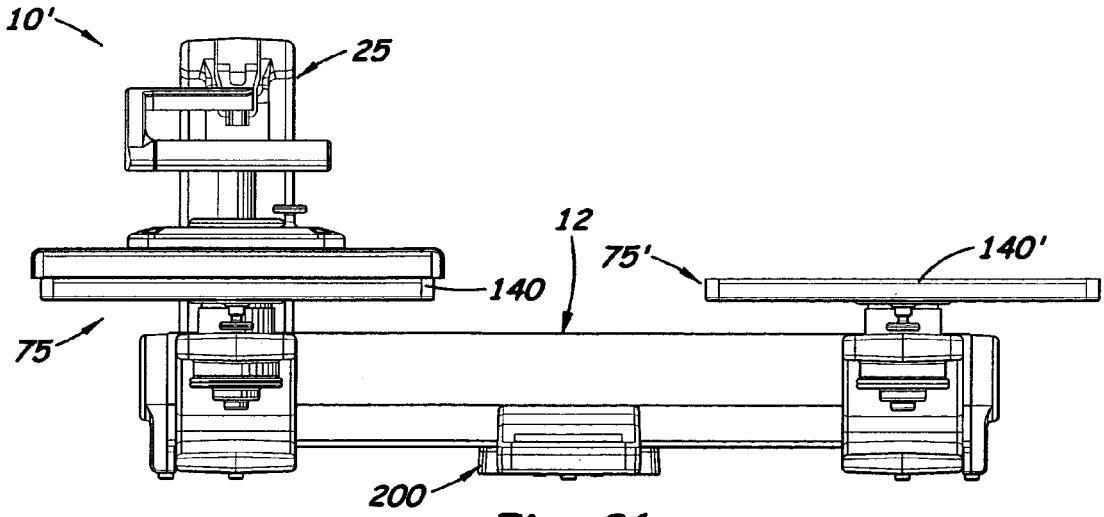
FIG. 21 is a front elevational view of the lateral heat press machine shown in FIG. 20.
Figure 22:
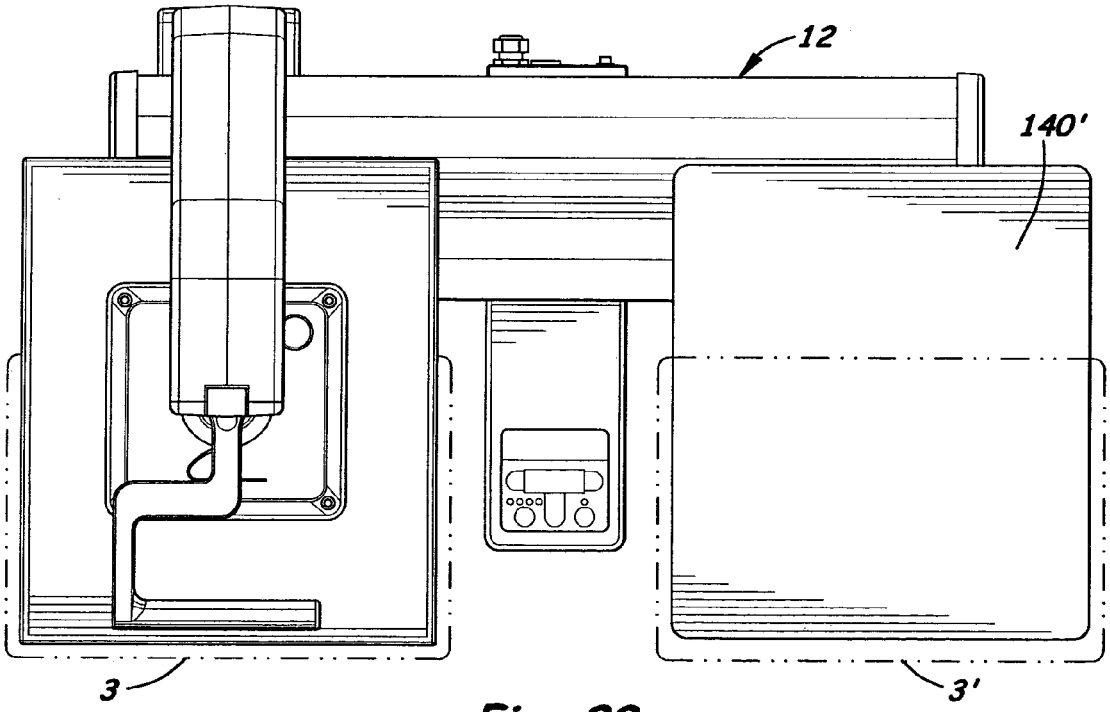
FIG. 22 is a top plan view of the lateral heat press machine shown in FIGS. 20 and 21.

Referring to the accompanying FIGS. 1–4, there is shown a lateral heat press machine 10 disclosed herein that includes a lightweight chassis assembly 12 with at least one workstation assembly 75 attached at one end and a vertically aligned sliding arm assembly 25 that extends over the workstation assembly 75 to apply a downward pressing force on a garment or substrate (generally denoted as 3) placed between two platens 66, 140. Because the chassis assembly 12 is designed to be used with several workstation assemblies 75, 75' as shown in FIGS. 20–22, the sliding arm assembly 25 is designed to slide laterally in opposite directions over a chassis assembly 12 to work with both workstation assemblies, 75, 75'.

Figure 1:
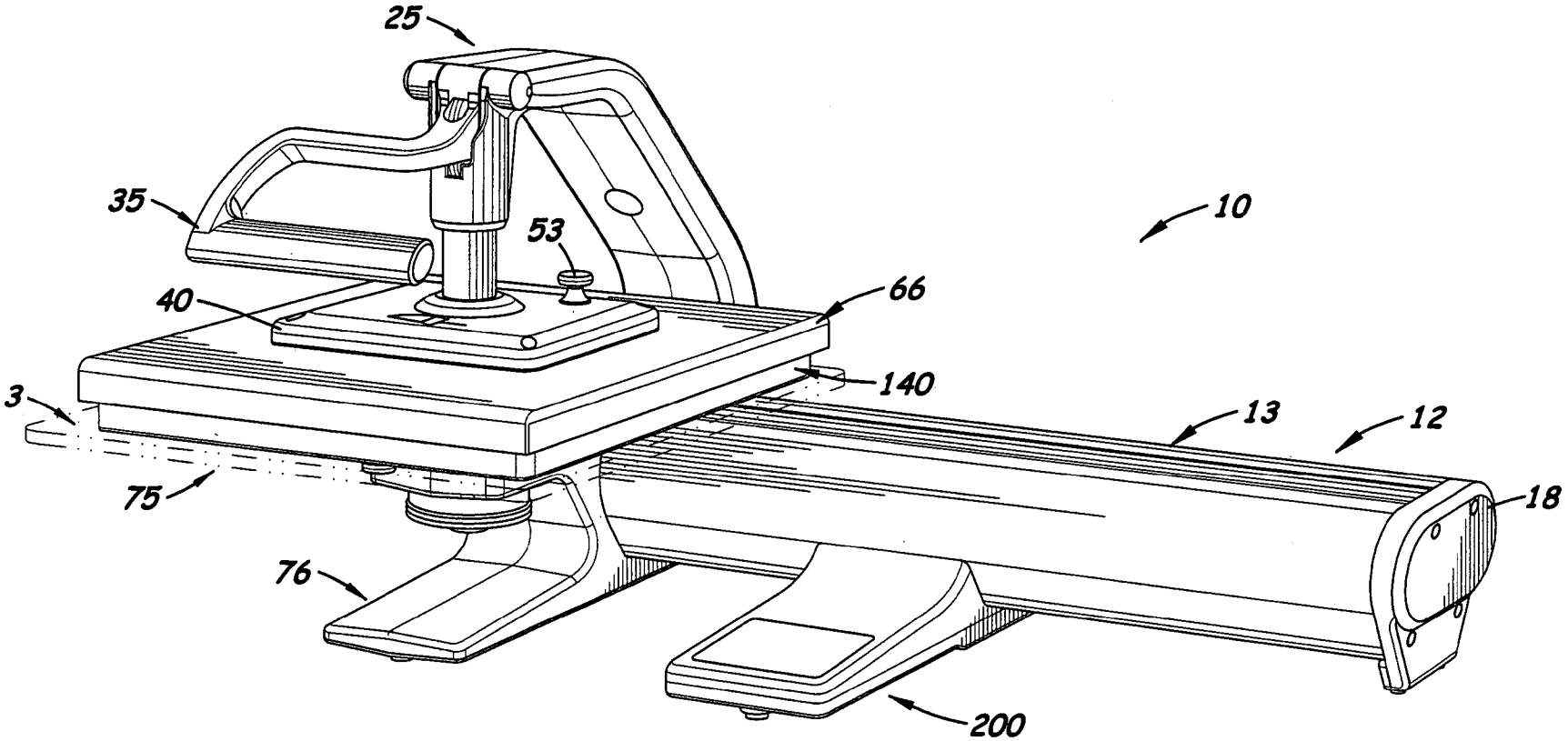
FIG. 1 is a perspective view of the lateral heat press machine disclosed herein.
Figure 2:
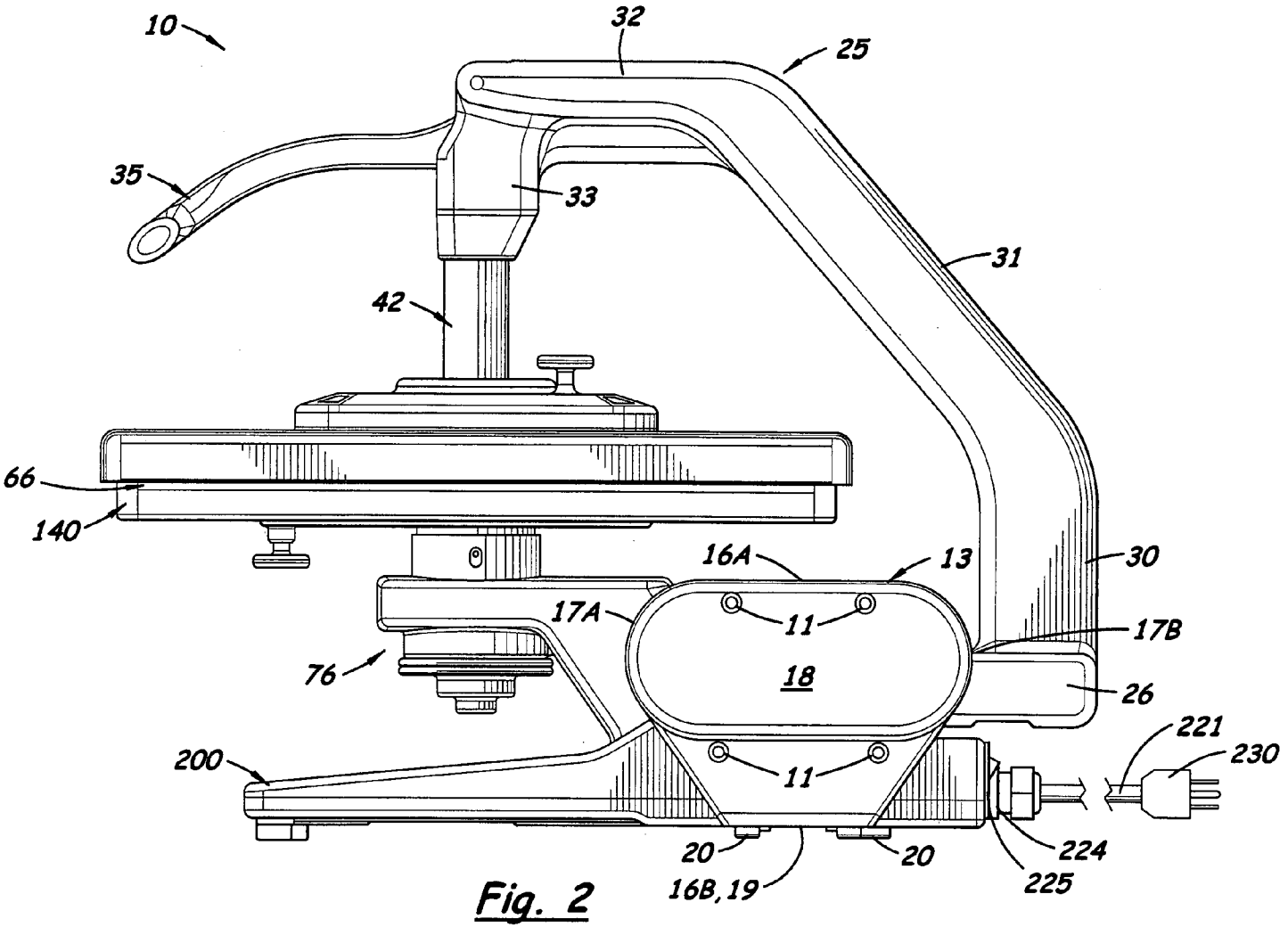
FIG. 2 is a right side elevational view of the lateral heat press machine.
Figure 3:
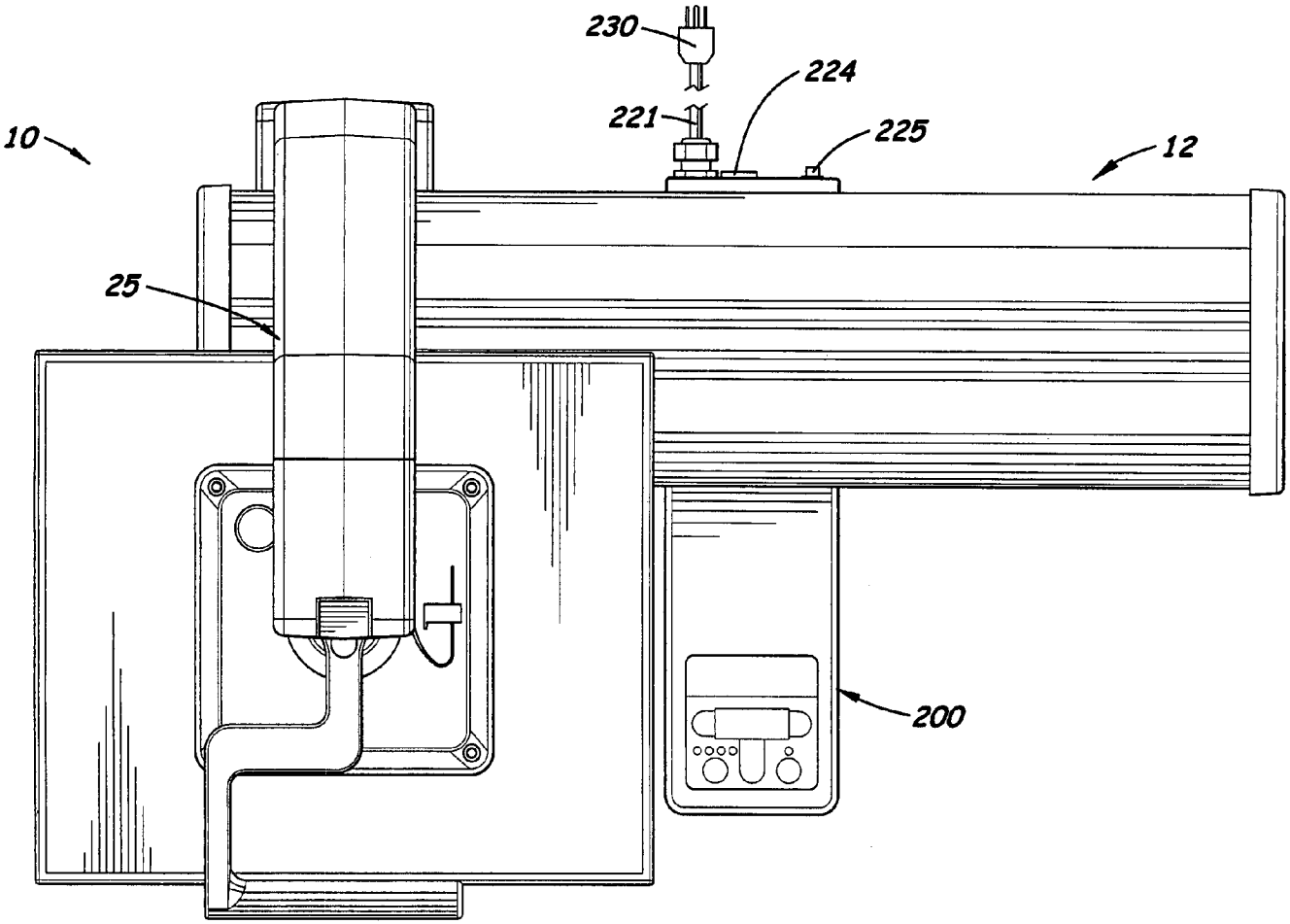
FIG. 3 is a top plan view of the lateral heat press machine.
Figure 4:
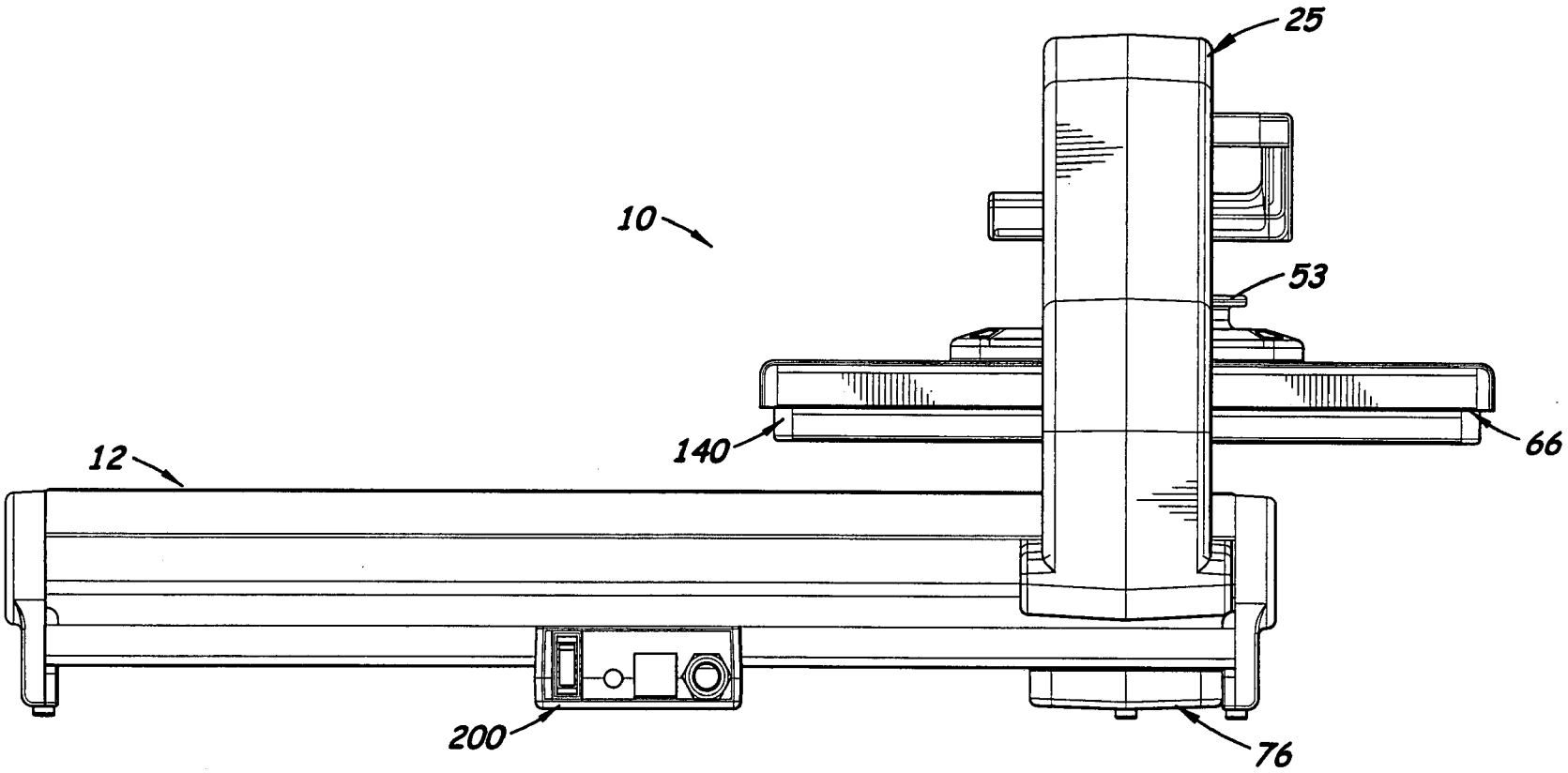
FIG. 4 is a rear elevational view of the lateral heat press machine.
Figure 5:
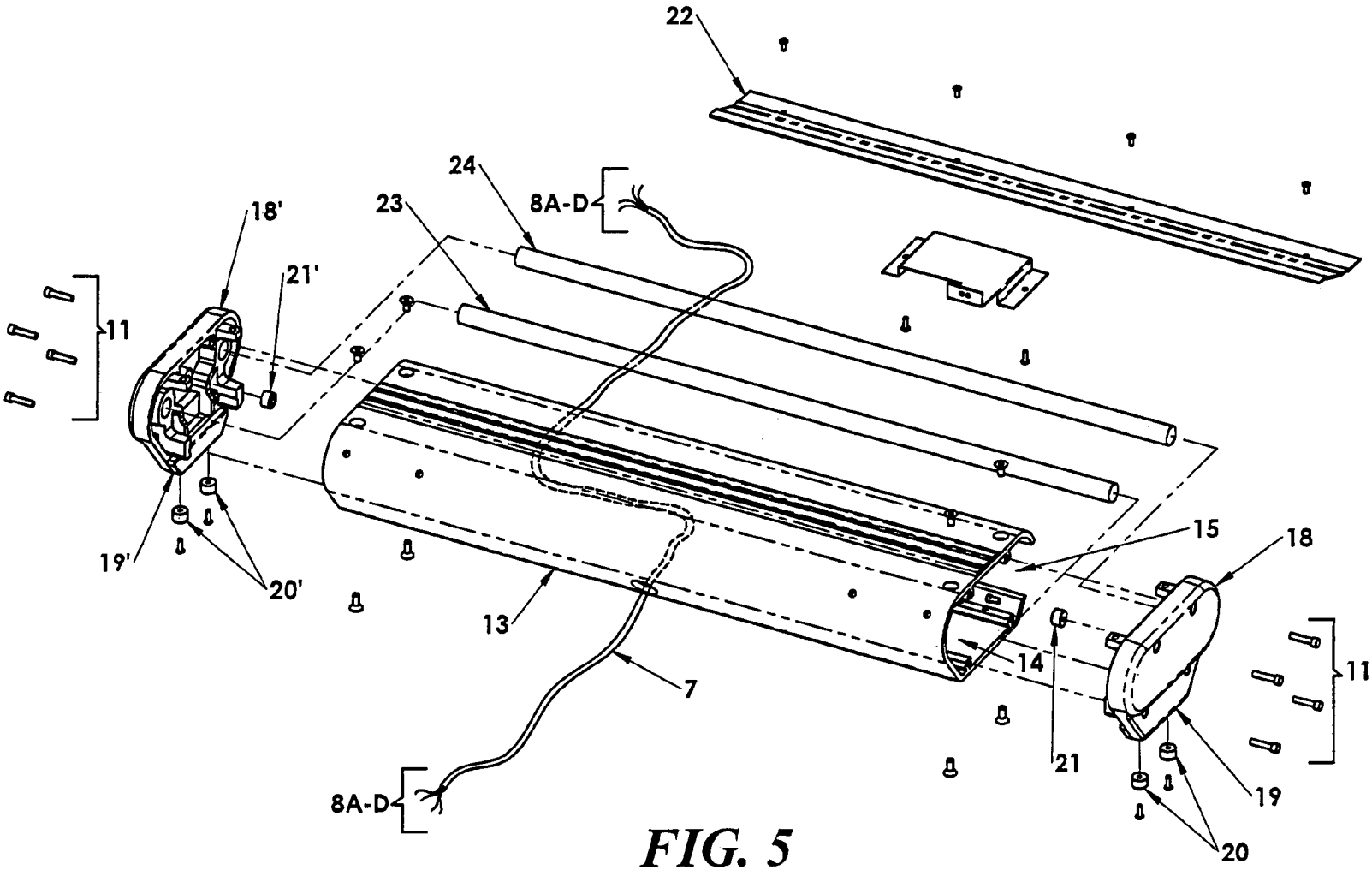
FIG. 5 is an exploded, perspective view of the elongated body.

The chassis assembly 12 includes a single piece, hollow elongated body 13 with a center cavity 14 and two removable end caps 18, 18' located at its opposite ends. As shown in FIGS. 2 and 5, the elongated body 13 is an oval-shaped structure with parallel flat top and bottom surfaces 16A, 16B, respectively, and downward converging front and rear surfaces 17A, 17B, respectively. Formed on the rear surface 17B is a fully extending slot 15 that is sufficiently wide to allow the horizontal segment on the sliding arm assembly 25 to extend into the center cavity 14. Located inside the cavity 14 are two fully extending, longitudinally aligned rails 23, 24. The two rails 23, 24, which are circular in cross-section, are parallel and attached at their opposite ends to the inside surfaces of two end caps 18, 18' attached over the opening ends of the elongated body 13. Suitable threaded connectors 11 are used to attach the two end caps 18, 18' to the elongated body 13. Attached to the lower surface 19, 19' of each end cap 18, 18' are two rubber feet 20, 20', respectively. Attached to the inside surface of each end cap 18, 18' is a bumper 21, 21' which protects the sliding arm assembly 25 from impacts with the end caps 18, 18'. Also, located inside the elongated body 13 is a longitudinally aligned cable cover 22 that covers a cable 7 that extends between the sliding arm assembly 25 and the console 200 discussed further below. The cable cover 22 protects the cable 7 from the sliding arm assembly 25 as it moves longitudinally over the elongated body 13. The cable cover 22 also prevents accidental contacts with the cable 7 by objects extended into the slot 15.

Figure 6:
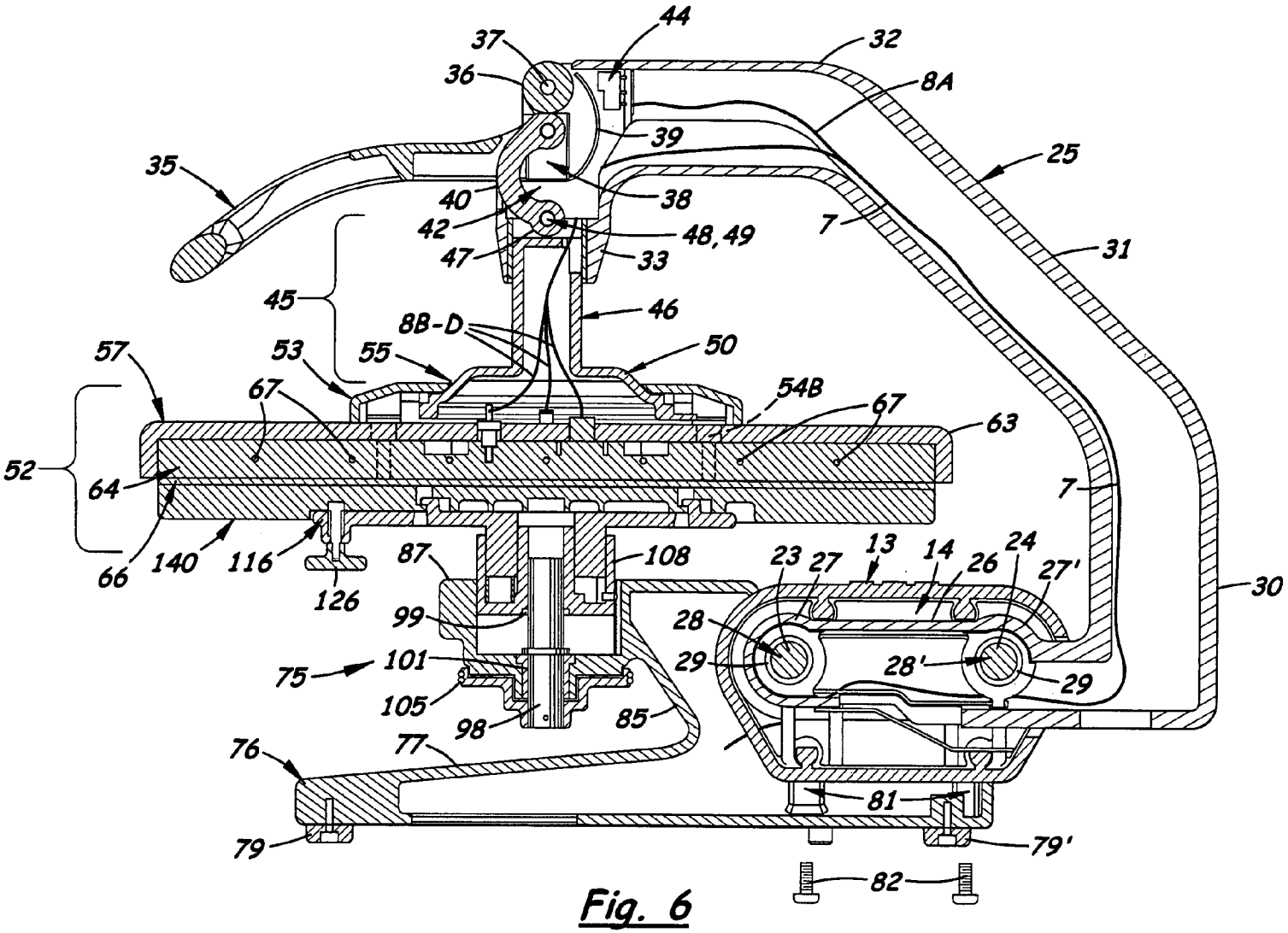
FIG. 6 is a sectional side elevational view of the lateral heat press.

As shown in FIGS. 2 and 6, the sliding arm assembly 25 includes a horizontally aligned, lower section 26 that extends through the slot 15 and into the cavity 14. Formed on the lower section 26 are two spaced apart circular sections 27, 27' with elongated bores 28, 28' formed therein designed to receive the rails 23, 24. Located inside each bore 28, 28' are ball bearing bushings 29, 29' that reduce friction and binding on the rails 23, 24 as the lower section 26 slides over the two rails 23, 24.

Figure 9:
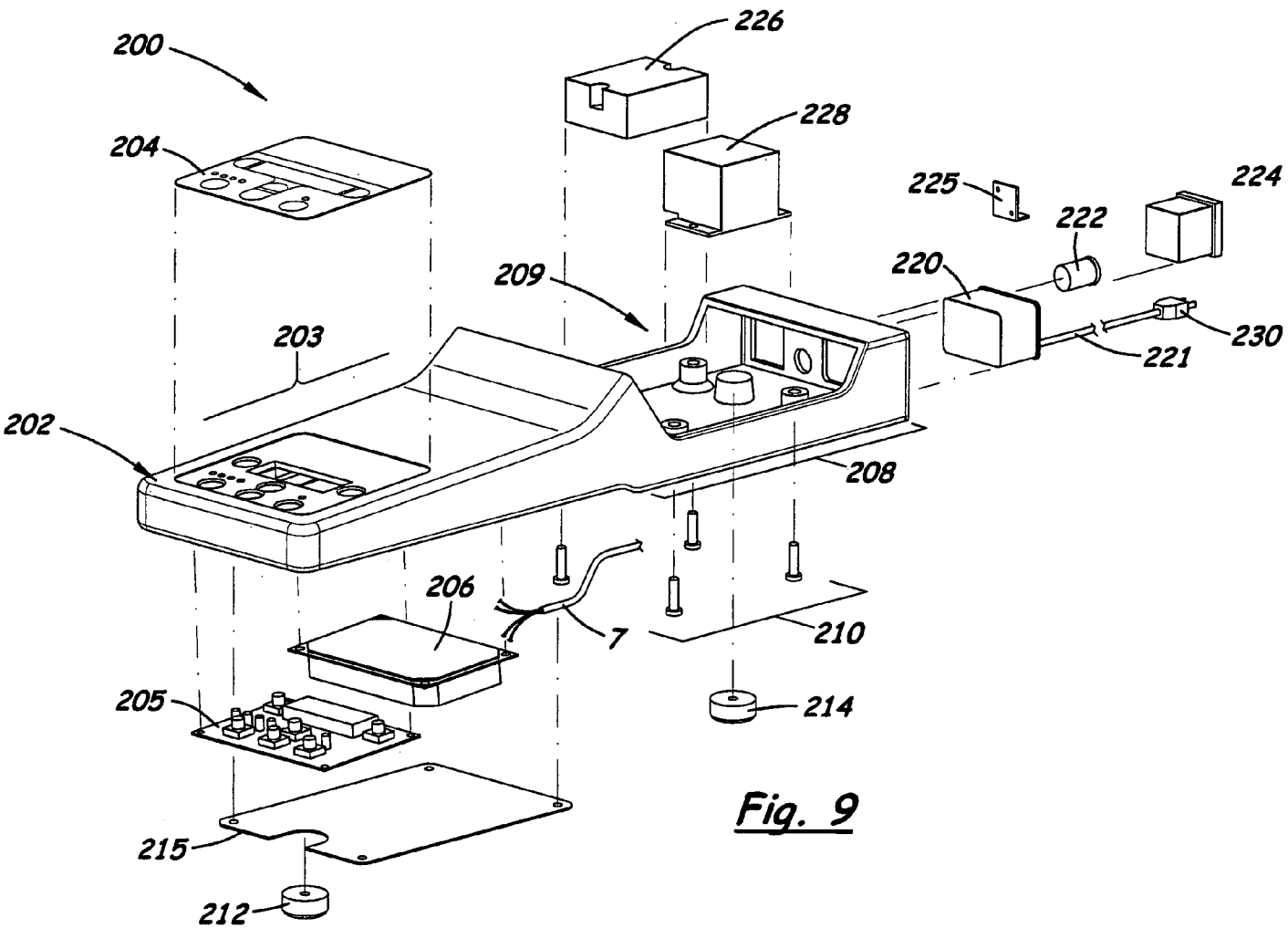
FIG. 9 is an exploded view of the console.

In addition to the lower section 26, the sliding arm assembly 25 includes an integrally formed hollow vertical segment 30, a hollow diagonal segment 31, a hollow upper horizontal segment 32, and a hollow vertical neck 33. Extending through the three segments 30, 31, 32 and the neck 33 is the electrical cable 7 (see FIG. 6). The cable 7 includes five wires 8A–E that connect at one end to a main PCB 206 located in a console 200 (shown in FIG. 9). The opposite ends of four wires 8A–D connect to a heating element 67, and to a resistive temperature device 68. Also connected to an over-temperature cut-off switch 69 that is imbedded or attached to the upper platen 66. The fourth wire 8D connects to a timer switch 44 located in the upper horizontal segment 32.

Figure 7:
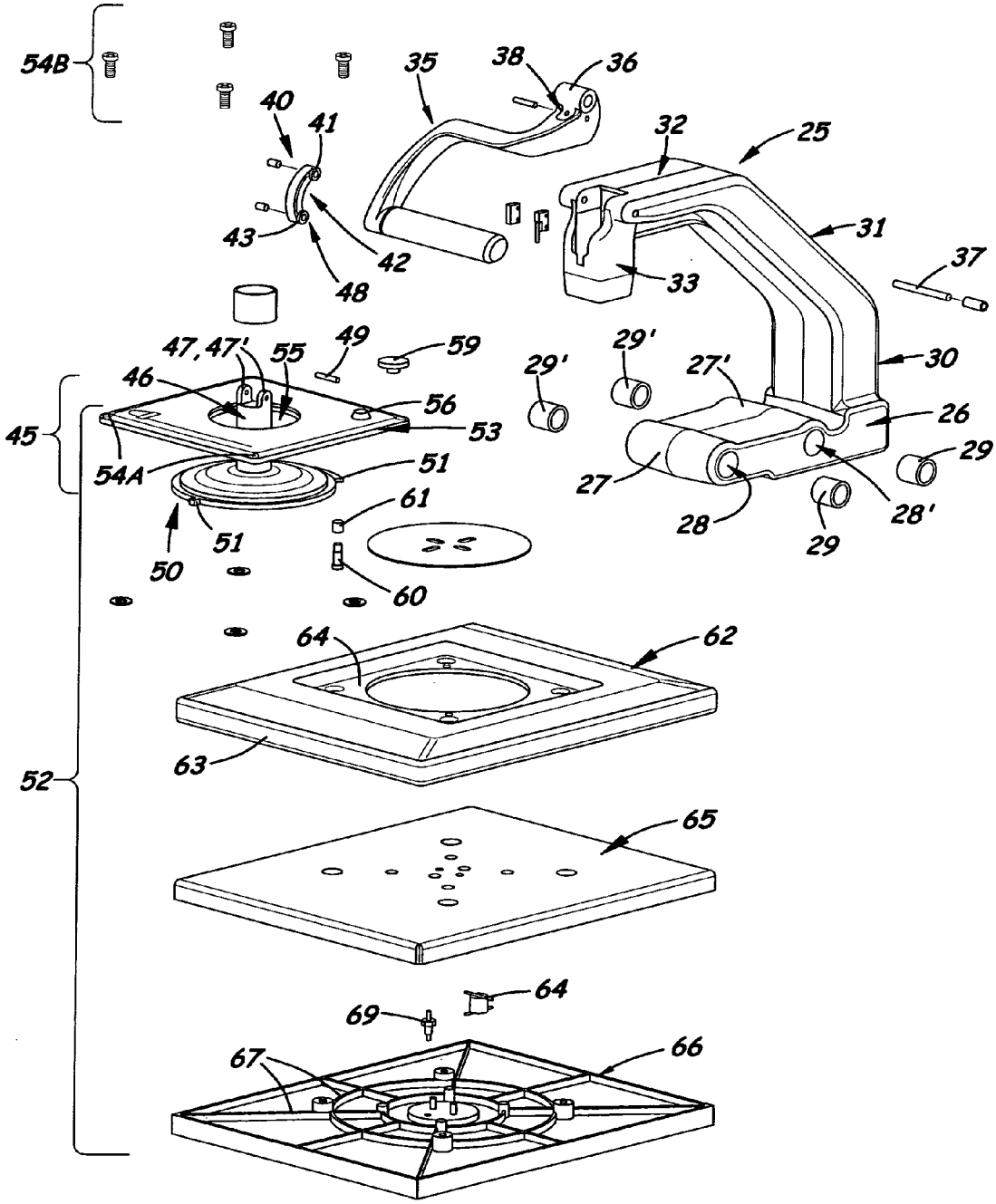
FIG. 7 is an exploded view of the sliding arm assembly.
Figure 8:
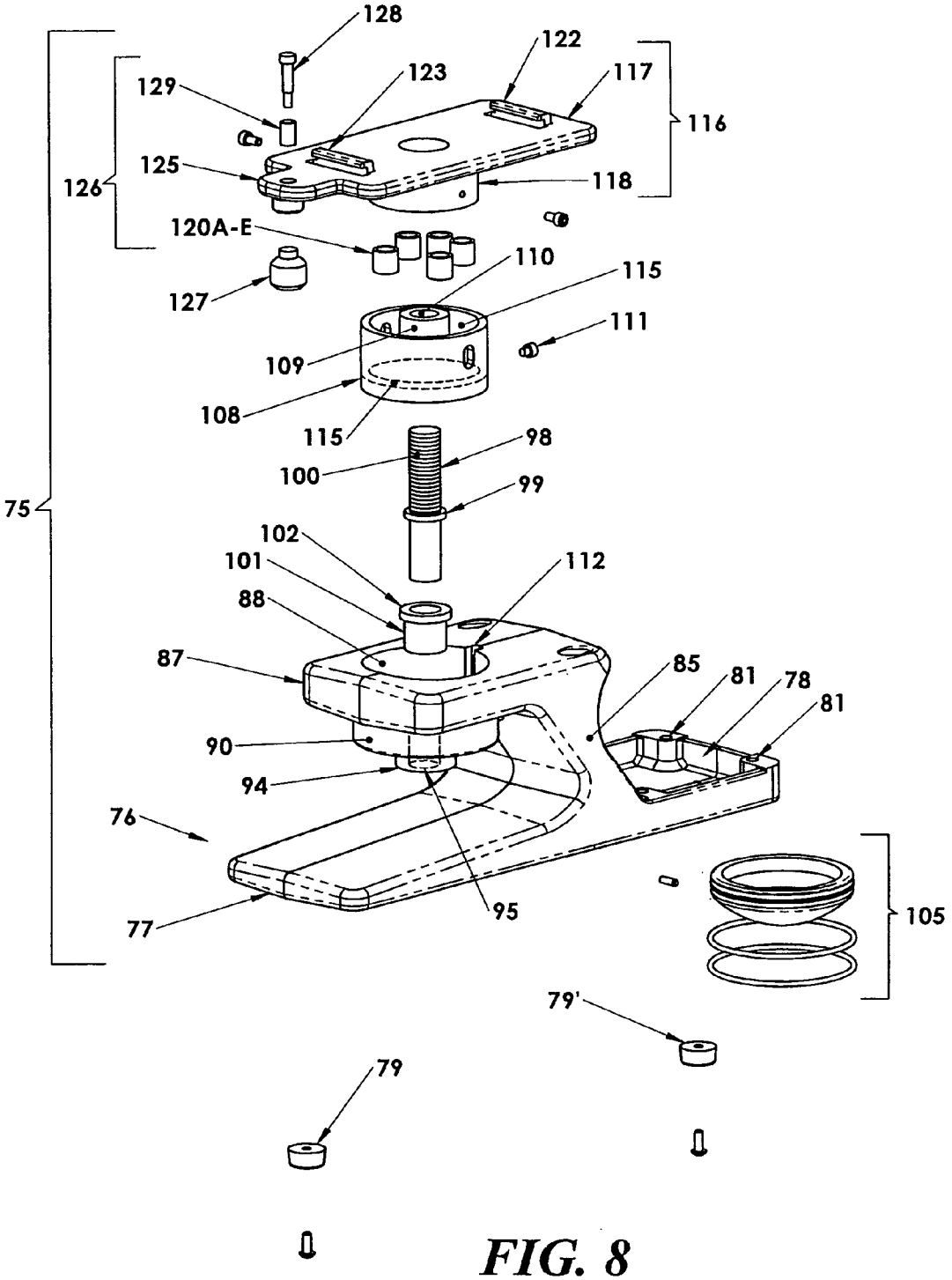
FIG. 8 is an exploded view of the workstation pedestal.

Attached to the vertical neck 33 is a movable L-shaped handle 35. As shown in FIGS. 6 and 7, located on the upper end of the handle 35 is a cylindrical hub 36. The hub 36 is attached to the neck 33 via a first transversely aligned pin 37. Formed inside the handle 35 and adjacent to the hub 36 is a passageway 38 designed to receive a C-shaped pivot arm 40. The upper head 41 of the pivot arm 40 is attached to the handle 35 at a point adjacent to the hub 36. As the end of the handle 35 is rotated upward, the upper head 41 of the pivot arm 40 rotates around the hub 36 from approximately a 6 o'clock position to approximately a 12 o'clock position. As the pivot arm 40 is rotated around the hub 36, the hub 36 fits into the C-shaped center void area 42 in the pivot arm 40 thereby temporarily holding the pivot arm 40 over the hub 36. Formed on the rear surface of the handle 35 adjacent to the hub 36 is a curved surface 39 (shown more clearly in FIG. 6) which presses against a contact (not shown) on the timer switch 44. During operation, as the handle 35 is lowered or raised on the sliding arm assembly 25, the timer switch 44 is turned on and off respectively, which activates and deactivates a timer circuit built into the main PCB 206 discussed further below.

The lower end 43 of the pivot arm 40 is rotatably attached to a cylindrical plunger 45. The plunger 45 is an inverted T-shaped structure comprising a vertically aligned post 46 and a horizontal aligned, lower conical-shaped hub 50. Located on the upper end of the post 46 are two spaced apart, upward extending ears 47, 47'. The lower end 43 of the pivot arm 40 has a transversely aligned hole 48 formed therein. During assembly, the lower end 43 of the pivot arm 40 fits into the space between the two ears 47, 47' and a second pin 49 is inserted through the space between the two ears 47, 47' and the hole 48 to rotatably attach the pivot arm 40 to the post 46.

Attached to the lower end of the post 46 is a rotating upper platen assembly 52 that includes a platen management plate 53, a platen jacket 62, an insulation layer 65, and an upper platen 66. As shown in FIG. 7, the platen management plate 53 is a raised cap structure that includes a central hole 55 that enables the post 46 to extend through. Formed between the plate 53 and the platen jacket 62 is a cavity 64 in which the hub 50 is disposed. The central hole 55 has a sufficiently small diameter to prevent the hub 50 from disengaging from the platen management plate 53. Formed on the platen management plate 53 are four connection holes 54A (only two shown) that receive four suitable connectors 54B to connect the platen management plate 53 to the platen jacket 62, the insulation layer 65 and the upper platen 66. Also formed on the platen management plate 53 is a fifth hole 56 used to receive the connection rod 60 used on a quick connect knob assembly 58. The quick connect knob assembly 58 includes a knob 59, a connection rod 60 and a spring 61. The knob 59, connection rod 60 and the spring 61 are assembled on the plate 53 so that the connection rod 60 is biased in a downward direction when attached to the plate 53.

Formed on the outer edge of the plunger's conical hub 50 are two semi-circular notches 51. The notches 51 are radially aligned approximately 90 degrees apart, and extend outward and selectively engage the lower tip of a connection rod 60 used on the quick connect knob assembly 58 and limit rotation of the plate 53 around the hub 50. The spring 61 forces the connection rod 60 downward to engage one of the notches 51. When the knob 59 is pulled upward, the tip of the connection rod 60 disengages the notch 51 thereby enabling the platen management plate 53 to rotate 90 degrees around the post 46. By selectively engaging and disengaging the quick connect knob assembly 58 from the hub 50 the operator is able to easily rotate the entire upper platen assembly 52 between portrait and landscape orientations. When the upper platen assembly 52 is oriented to the desired orientation, the knob 59 is released which automatically locks the upper platen assembly 52 in the new desired orientation.

In the preferred embodiment, the platen management plate 53 and the platen jacket 62 are made of lightweight plastic or metal. The insulation layer 65 is made of lightweight insulation material while the upper platen 66 is made of heat conductive aluminum or steel. The plate jacket 62 includes pendent sidewalls 63 that extend downward and partially cover the insulation layer 65. Formed on the top surface of the jacket 62 is a recessed cavity 64 complimentary in shaped with the platen management plate 53 so that the platen management plate 53 may partially fit therein during assembly.

The upper platen 66 is located below the insulation layer 64. Imbedded or formed inside the upper platen 66 are heating elements 67 which heat the upper platen 66 during the pressing operation. Attached to the upper platen 66 is a resistive temperature device 68 and an over-temperature cut-off switch 69 that are used to monitor and regulate the temperature of the upper platen 66.

During operation, the handle 35 forces the plunger 45 downward that, in turn presses the upper platen 66 against a lower platen 140 supported by a workstation assembly 75. As the handle 35 is forced downward, the timing switch 44 located on the sliding arm assembly 25 is moved to the ON position which, in turn, automatically activates the timer circuit 232 on the main PCB 206 (see FIG. 25). When the handle 35 is lifted, the timer switch 44 is moved to the OFF position that de-activates the timer circuit 232.

Perpendicularly aligned and attached to the chassis assembly 12 is at least one workstation assembly 75 designed to securely hold the lower platen 140 under the upper platen 66. In the preferred embodiment, the workstation assembly 75 includes a pedestal 76 with a horizontal lower base 77, a forward extending diagonal strut 85, and a horizontally aligned upper platform 87. Formed on the rear portion of the lower base 77 is a rear cavity 78 designed to receive the lower section of the elongated body 13 perpendicularly aligned thereto. Attached to the bottom surface of the lower base 77 are two rubber feet 79, 79' that support the pedestal 76 on a flat support surface. Suitable threaded connectors 80 extend through holes 81 formed on the rear cavity 78 and connect to threaded holes (not shown) on the elongated body 13 to securely connect the pedestal 76 to the elongated body 13.

Formed on the upper platform 87 is a vertically aligned cylindrical bore 88 with a vertically aligned keyway 112 formed on its inside surface. Extending downward below the bore 88 is a lower cylindrical portion 90. Coaxially aligned and integrally formed on the lower portion 90 is a smaller cylindrical neck 94 with a center bore 95 formed therein that is coaxially aligned with the center axis of the larger cylindrical bore 88 formed in the upper platform 87. A bushing 101 is longitudinally aligned and disposed into the center bore 95 and used to support shaft 98 discussed further below. The bushing 101 includes an upper wide collar 102 slightly wider in diameter than the bore 95 thereby allowing the bushing 101 nest inside the bore 95.

Coaxially aligned and registered over the lower section of the large portion 90 and over the lower cylindrical neck 94 is a large turn knob 105. During assembly, the shaft 98 extends through the bore 88 and the bushing 101. The shaft 98 includes a circular shoulder 99 approximately located at the shaft's 98 mid-line axis. The upper portion 100 of the shaft 98 above the shoulder 99 is threaded. During assembly, the lower end of shaft 98 is inserted into the bushing 101 so that the shoulder 99 rests against the bushing's upper edge. The upper threaded portion 100 of the shaft 98 extends upward and receives an elevator bushing 108 attached to the quick release locking plate 116 discussed further below. During assembly, the turn knob 105 is attached to the end of the shaft 98 that extends through the bushing 101. When the turn knob 105 is rotated, the shaft 98 rotates which lowers or raised raises the quick release locking plate 116.

The elevator bushing 108 is coaxially aligned over the threaded portion of the shaft 98. The elevator bushing 108 includes a small diameter central neck 109 with a threaded bore 110 formed therein. The threaded bore 110 is connected to the threaded upper portion 100 of the shaft 98 thereby connecting the elevator bushing 108 to the shaft 98. Attached to the side of the elevator bushing 108 is a pin 111 that fits into the keyway 112 formed on the inside surface of the cylindrical bore 88. During use, the head of the pin 111 extends outward and holds the elevator bushing 108 in a radially fixed position inside the cylindrical bore 88. When the turn knob 105 and the shaft 98 are manually rotated, the elevator bushing 108 is lowered or raised on the upper platform 87. This feature is important because it allows the height of the lower platen 140 to be adjusted which is important for varying the amount of pressure exerted against a garment or substrate positioned between the upper and lower platens, 66, 140, respectively. By varying the height, garments or substrates made of materials having different thickness may be used.

Formed on the side of the neck 109 are two holes 113 (one shown) with which are radially aligned with two slotted holes 113, 114 formed on the elevator bushing 108. During assembly, the holes 113 and 114 are aligned and registered and two screws 115, 115' are inserted through them to securely attach the elevator bushing 108 to the neck 109.

Located above the elevator bushing 108 is a quick release locking plate 116. The locking plate 116 includes a rectangular-shaped body 117 with an integrally formed, downward extending, cylindrical neck 118. The neck 118 is hollow and designed to nest into the elevator bushing 108. Formed inside the upper portion of the elevator bushing 108 is a circular gutter 115. Disposed inside the gutter 115 are a plurality of vertically aligned springs 120A–E that press against the inside surface of the cylindrical neck 118 to support and bias the locking plate 116 in a suspended position over the elevator bushing 108. One purpose of the springs 120A–E is to provide resiliency or 'give' between the elevator bushing 108 and locking plate 116 which eliminates the need for the operator to finely adjust the height of the lower platen 140 with respect to the upper platen 66.

Formed on the upper surface of the horizontal body 117 are two upper extending lugs 122, 123 designed to engage two complimentary lug openings formed on the bottom surface of each of the exchangeable lower platens 140, 150, 160, or 180 discussed further below. Integrally formed on one end of the horizontal base 117 is a narrow section 125 upon which a quick release knob assembly 126 is attached. The knob assembly 126 includes a knob 127 attached to a vertical pin 128 that extends upward through the section 125. Disposed around the pin 128 is a spring 129 that biases the pin 128 in an upward direction. Formed on the upper end of the pin 128 is a wide tip that engages a hole also formed on the bottom surface of the lower platens 140, 150, 160, 180 as discussed further below.

Figure 11:
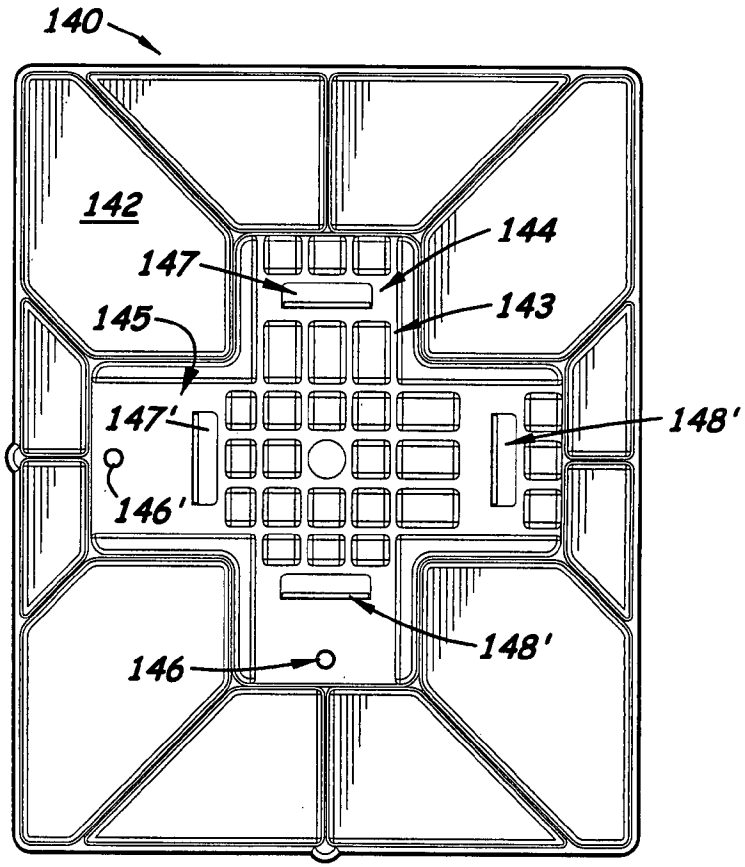
FIGS. 10–11 are top and bottom plan views, respectively, of a flat rectangular-shaped lower platen.
Figure 10:
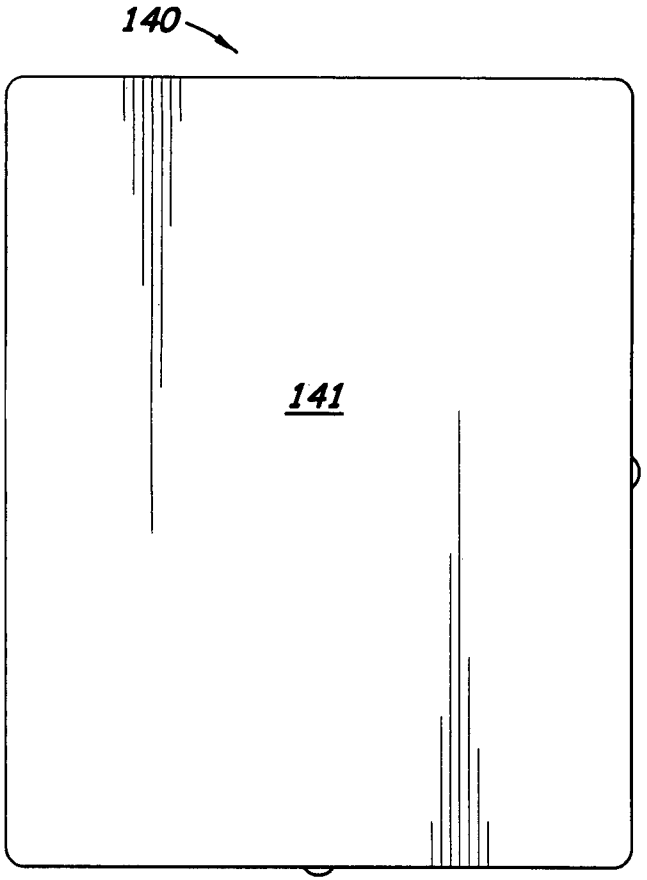

In the first embodiment shown in FIGS. 10 and 11, the lower platen 140 is a rectangular, planar structure with a flat top surface 141 and a flat bottom surface 142. Formed on the bottom surface 142 is a centrally aligned x-shaped cavity 143. The cavity 143 is made of two, intersecting small rectangular cavities 144, 145, each being complimentary in shape with the locking plate 116 used on the workstation assembly 75. By inserting the locking plate 116 into one of the two cavities 144, 145, the lower platen 140 can be aligned in either a portrait or landscape orientation, respectively. Located inside each cavity 144, 145 and near one end is a partially extending hole 146 and 146' respectively. During assembly, the upper end of the pin 128 that extends upward from the locking plate 116 is inserted one of the holes 146 or 146' to lock the lower platen 140 onto the locking plate 116. Formed on the bottom surface 142 of the lower platen 140 inside each cavity 144, 145 are two pairs of keyways 147, 148, and 147', 148', respectively. The keyways 147, 148 and 147', 148' are complimentary in shape and orientation with the two raised nesting lugs 122, 123 formed on the top surface of the horizontal base 113. During operation, the two lugs 118, 120 engage one pair of keyways 147, 148 or 147', 148' to keep the lower platen 140 properly aligned on the locking plate 116.

Figure 13:
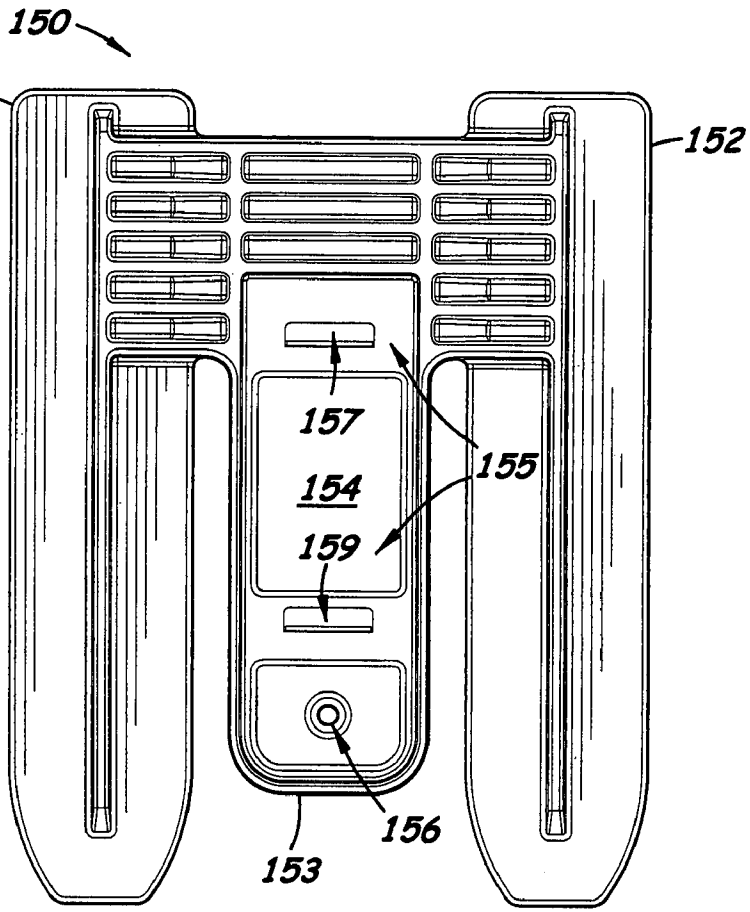
FIGS. 12–13 are top and bottom plan views, respectively, of a sleeve-style lower platen.
Figure 12:
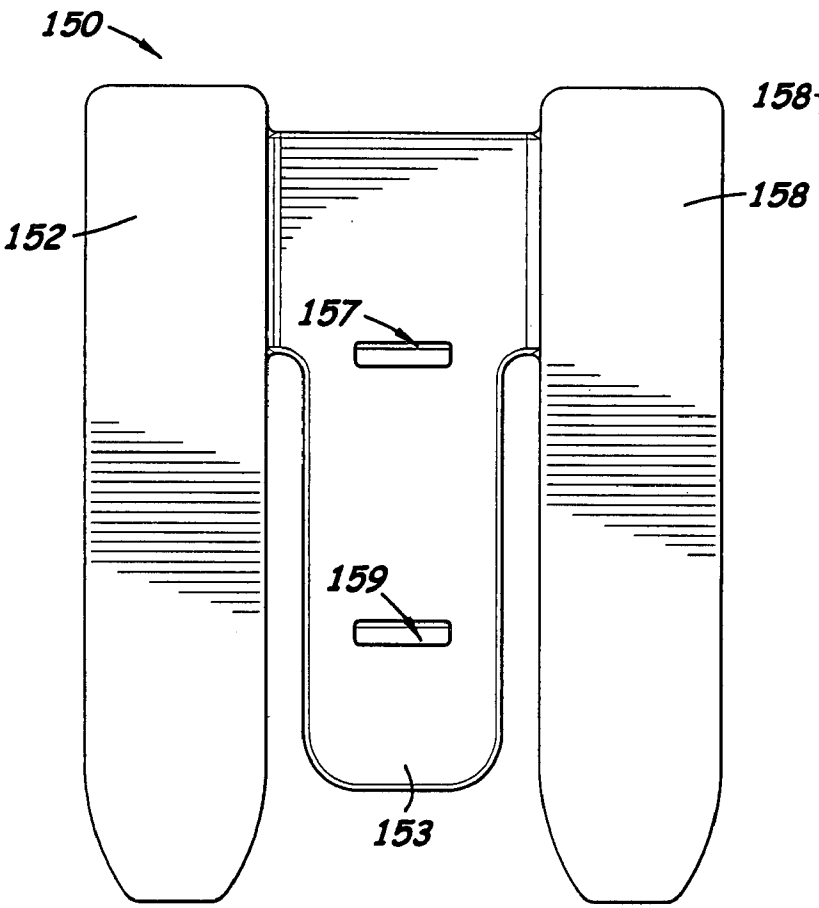

FIGS. 12 and 13 show a second embodiment of the lower platen 150, called a sleeve-style platen, that includes two large outer leg extensions 152, 158, respectively, and a shorter, center leg extension 153. The leg extensions 152, 153, 158 are aligned parallel and spaced apart so that one or two shirt sleeves may be placed over the top surfaces of the two outer leg extensions 152, 158. Formed on the bottom surface 154 of the center leg extension 153 is a longitudinally aligned recessed cavity 155 complimentary in shape with the locking plate 116. Also formed on the near the front edge of the cavity 155 is a partially extending hole 156 designed to receive the pin 128 on the knob assembly 126. Two complementary-shaped keyways 157, 159 are also formed inside the cavity 155 that receive the two raised nesting lugs 122, 123 on the lock plate 116.

Figure 14:
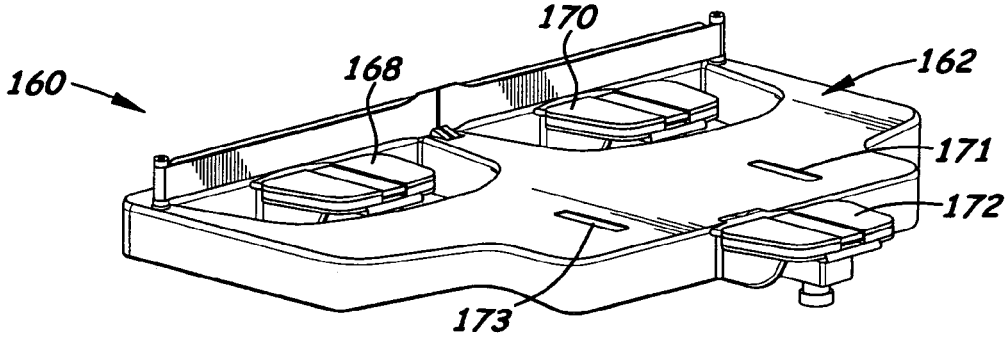
FIGS. 14–16 are perspective and top and bottom plan views, respectively, of the hat-style lower platen.
Figure 15:
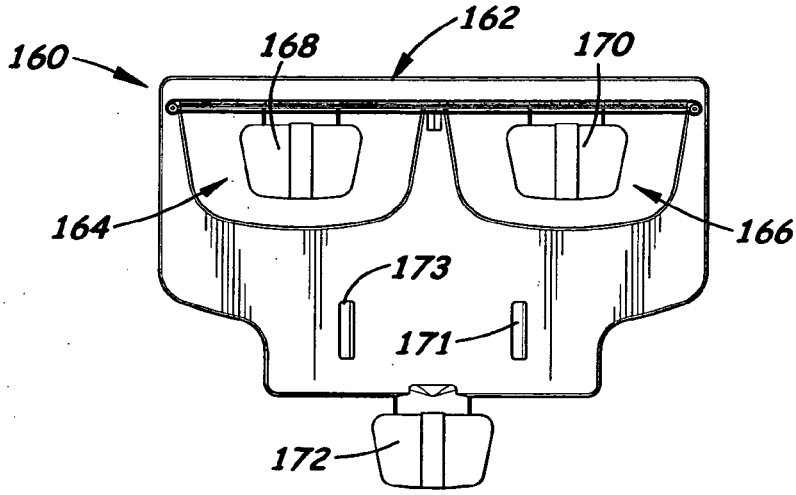
Figure 16:
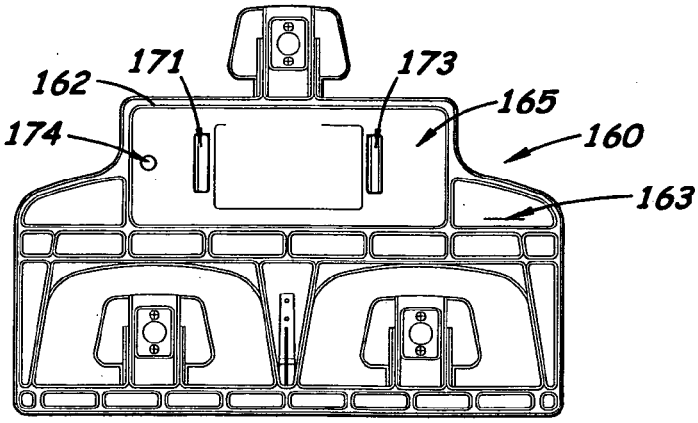

FIGS. 14, 15 and 16 show a third embodiment of the lower platen 160, called a hat-style lower platen, used to press graphics or images on the surfaces of a hat. The lower platen 160 includes an irregular-shaped body 162 with two void areas 164, 166. Formed inside each void area 164, 166 is a flat hat support surface, 168, 170 respectively. Formed centrally on the lateral edge of the body 162 is a third hat support surface 172. The top surfaces of the three hat support surfaces 168, 170, 172 are substantially level with the top surface of the body 162. Formed on the bottom surface 163 of the main body 162 is a transversely aligned recessed cavity 165. The locking plate 116 fits into the cavity 165. Formed on the front end of the recessed cavity 165 is a partially extending hole 174 designed to receive the pin 128 used to lock the lock plate 116 into the cavity 165. Also formed in the cavity 165 are two keyways 171, 173 designed to receive the two lugs 122, 123 formed on the locking plate 116.

When the locking plate 116 is inserted into the cavity 165, the lower platen 160 is aligned in a portrait orientation, with the third hat support surface 172 extending laterally to the right. One or two hats may be placed over the first and second hat support surfaces 168, 170, to press images or graphics on their front surfaces. The third hat support surface 172 may be used to press graphics or images on the back or side surface of the hat's crown.

Figure 17:
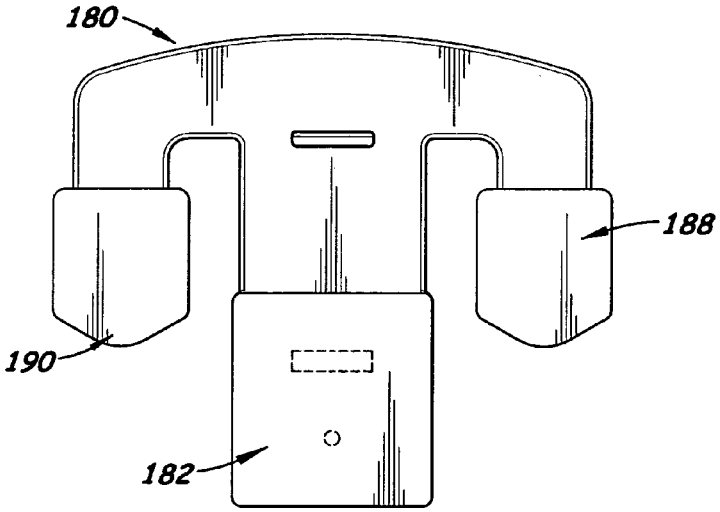
FIGS. 17–19 are top, bottom, and side elevational views, respectively, of the pocket/universal-style lower platen.
Figure 18:
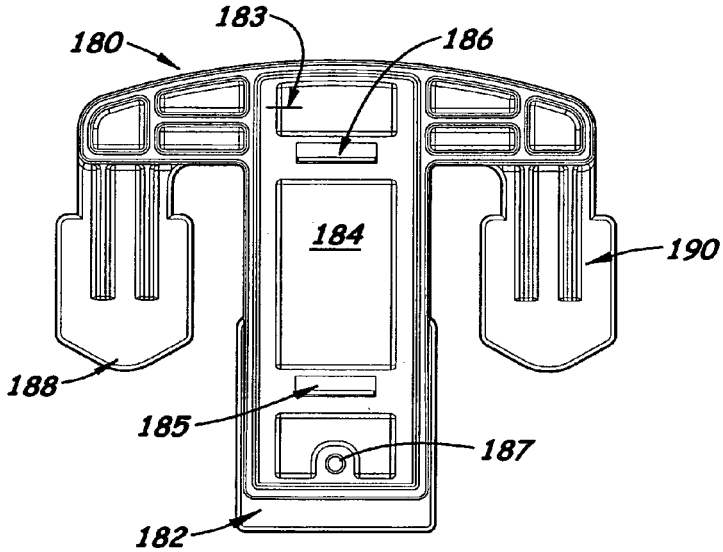
Figure 19:
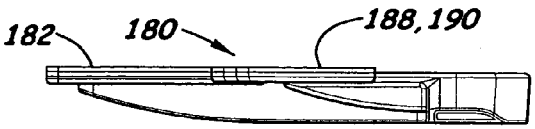

FIGS. 17, 18 and 19 show a fourth embodiment of the lower platen 180, called a pocket/universal-style lower platen 180. The pocket/universal-style lower platen 180 includes a long central leg 182 and two short outer legs 188, 190. The outer legs 188, 190 are spaced apart and parallel to the center leg 182. During use, single pockets on two shirts or two pockets on one shirt may be placed on the top surfaces of the center leg 182 or on the two outer legs 188, 190 and simultaneously imprinted. As shown in FIG. 19, the three arms 182, 188, 190 each have a converging front edge that allows them to be inserted into a pocket so that only the front surface of the pocket is imprinted.

Located on the bottom surface 183 of the center leg 182 is a recessed cavity 184. Located on the bottom surface 183 on opposite ends of the recessed cavity 184 are two keyways 185 and 186. Located in front of the front keyway 185 is a partially extending slot 187. During assembly, the locking plate 116 is aligned in a portrait orientation on the workstation pedestal 76. The lower platen 180 is then aligned and registered over the locking plate 116 so that locking plate 116 fits inside the recessed cavity 184. The lugs 120, 122 and shaft are inserted into the keyways. 185, 186, respectively and the pin 128 is inserted into the hole 187.

During assembly, one of the four above described lower platens 140, 150, 160, or 180 is selected and horizontally aligned over the workstation pedestal 76. Only the first lower platen 140 may be used in either landscape or portrait orientation. The second, third, and fourth lower platens, 150, 160, and 180 are all used in portrait orientation. With all of the lower platens 140, 150, 160, and 180, the locking plate 112 and the lugs 122, 123 and pin 128 are inserted into their keyways and holes, respectively, to securely lock the lower platens 140, 150, 160, and 180 onto the workstation pedestal 76. Because the workstation pedestal 76 is cantilevered and because it extends forward, the operator is able to 'over' or 'under' load the garment or substrate on the lower platen 140, 150, 160, 180. This feature allows the operator to expose and heat only one surface of the garment thereby preventing 'ghost' images from being produced on garment's opposite surface.

Attached to the chassis assembly 12 is a perpendicularly aligned console 200. The console 200 contains the main electrical components used on the press 10 and also helps to support the elongated body 13 on a horizontal support surface. The console 200, shown more clearly in FIG. 9, includes a low profile housing 202 designed to nest under and extend forward from the elongated body 13. The housing 202 includes a front section 203 with a keypad 204, a keypad PCB 206 and a main PCB 205. Formed on the rear section 208 of the housing 202 is an upward extending, cutout area 209 designed to receive the lower surface of the elongated body 13 via threaded connectors 210. Attached to the bottom surface of the housing 202 are two rubber feet 212, 214 used to support the housing 202 on a flat support surface. An access panel 215 is also attached to the bottom surface of the housing 202 to gain access to the keypad PCB 206 and the main PCB 205. Located inside the rear section 208 of the housing 202 is a 115 volts A.C. power module 220, a fuse holder 222, an electrical outlet receptacle 224, a transformer 226, and a solid state relay 228. As shown in FIG. 2, the outlet electrical receptacle 224 and a main power switch 225 are mounted on the rear surface of the housing 202. Attached to the power module 220 is a standard electrical cord 221 with a 115 A.C. volt male plug 230 connected at one end that connects to an external 115 volt electrical outlet to provide electricity to the press 10. The main power switch 225 is mounted on the rear surface of the power module 220. Wires (not shown) connect the power module 220 to the outlet electrical receptacle 224, to the transformer 226, and to the relay 228. Wires (not shown) also extend from the transformer 226 to the main PCB 206 to provide low voltage D.C. electric current thereto. The keypad PCB 206 is connected to the main PCB 205. As stated above, the cable 7 extends downward from the sliding arm assembly 25 and connects to connectors (not shown) located on the main PCB 205.

Figure 25:
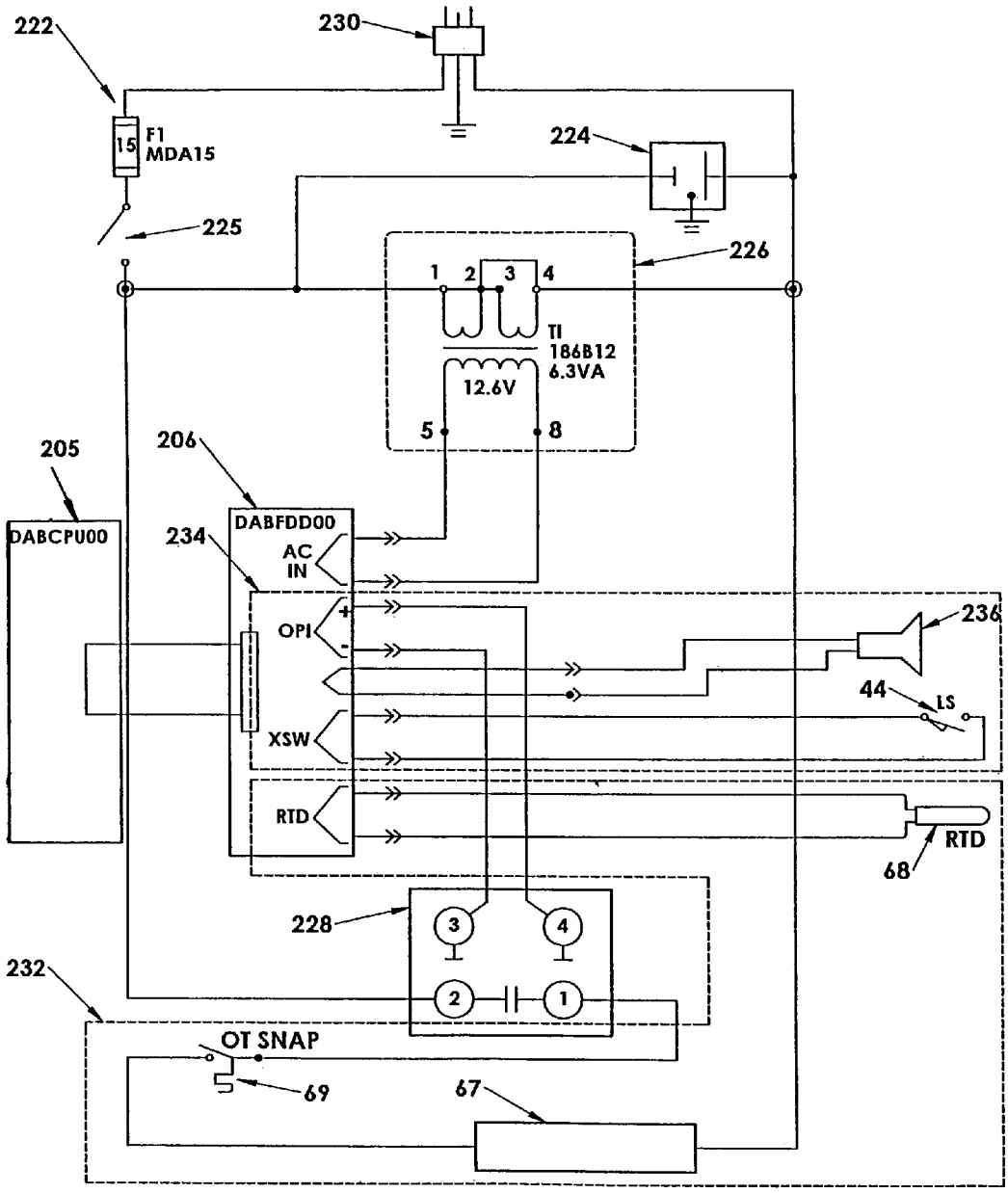
FIG. 25 is an electrical schematic diagram of the lateral heat press machine.

FIG. 25 is an electrical schematic diagram of the press. The main PCB 205 contains a heat control circuit (generally denoted as 232) and a timer circuit (generally denoted as 234). During use, the operator enters the amount of time for pressing into the keypad 204. When the main power button 225 is activated, the heat control circuit 232 is automatically activated for a predetermined amount of time. (Note: inaccurate unless talking about auto off safety feature). When the handle 35 is moved downward to press the upper plate 66 against the lower platen 140, the timer switch 44 in the swing arm assembly 25 automatically activates the timer circuit 234. After the appropriate time has elapsed, an audio alarm circuit (generally denoted as 236 in FIG. 25) is activated. If the handle 35 is not lifted after a predetermined amount of time (i.e. 5 minutes), the heat control circuit 232 is automatically deactivated. In the preferred embodiment, the heating circuit 232 has a 1500 Watt maximum capacity with the over temperature cut-off switch 69 mounted on the upper platen 66.

In the first embodiment shown in FIGS. 1–4, the press machine 10 includes one workstation assembly 75. In a second embodiment, shown in FIGS. 20–22, the press, denoted 10', includes two perpendicular aligned workstation assemblies 75, 75' attached to opposite ends of the elongated body 13. Each workstation assembly 75, 75' includes a workstation pedestal 76, 76' that supports one en of the lower platens (platens 140, 140' shown) discussed above. During operation, the sliding arm assembly 25 manually slides along the elongated body 13 between the two-workstation assemblies 75, 75'. As mentioned above, during setup, the upper and lower platens 66, 66', and 140, 140' are rotated into landscape or portrait orientation. Next, the desired amount of time is then entered into the keypad 204. The position of the first lower platen 140 is then set so that the proper amount of force is exerted on the garment or substrate. When the handle 35 is forced downward, the heat is on continuously and timer circuits 232, 234 are activated. When the desired amount of time has elapsed, the timer circuits 232, 234 are automatically inactivated. The audio alarm circuit 236 may be used to audio alarm to the operator.

While the sliding arm assembly 25 is being used to press a garment or substrate at one workstation assembly 75, a new garment or substrate is placed and aligned on the lower platen 140' on the second workstation assembly 75'. Once the first garment or substrate has been imprinted, the sliding arm assembly 25 is then release and laterally moved and positioned over the second lower platen 140'. By moving the sliding arm 25 assembly laterally between the two workstation assemblies 75, 75', and setting up the unused lower platen 140' as the other first lower platen 140 is being used, the operator is able to quickly imprint a large number of garments or substrates at a rate comparable to a silk screening process.

Figure 24:
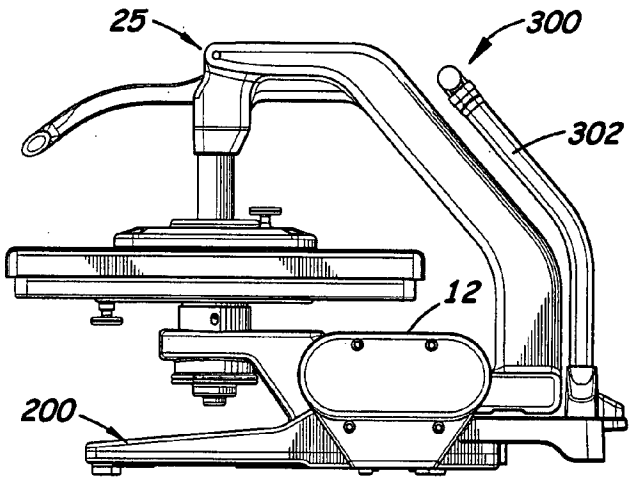
FIG. 24 is a side elevational view of the lateral heat press machine shown in FIG. 23.
Figure 23:
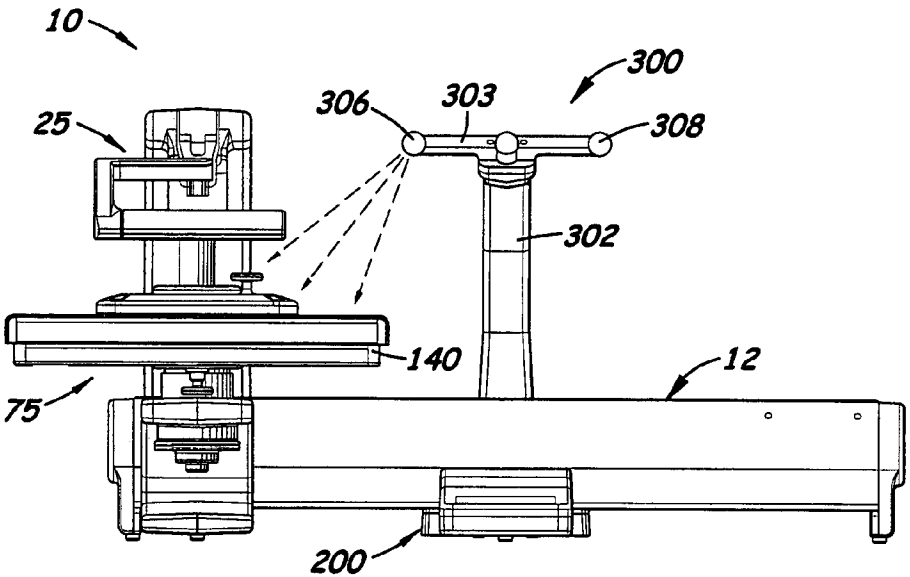
FIG. 23 is a front elevational view of the lateral heat press machine shown in FIGS. 1–4 with a laser alignment assembly attached thereto.

A laser guided garment alignment assembly 300 is also provided that enables the operator to easily and consistently align the garments or substrates over the lower platen 140, 140' thus making the pressing process faster and more accurate. As shown in FIGS. 23 and 24, the assembly 300 includes a vertically aligned curved arm 302 attached to the rear surface of the console 200. Attached to the top surface of the arm 302 is a horizontal member 303 with three adjustable optical lasers 306, 308 that produce reference points or lines (not shown) on the lower platens (plate 140 shown). During use, the garment or substrate are properly aligned on the lower platens 140, 140'. The lasers 306, 308 are then adjusted so that the points or lines are properly positioned and maybe used as a reference line for subsequent garments or substrates placed on the lower platen 140, 140' to be aligned against thereby ensuring quick and accurate imprinting when make large quantity of prints.

In summary, the above-described press 10 is a portable, structure that is easy to use and setup. Because the lower platen 140, 150, 160, and 180 can be easily exchanged and adjusted in height, the operator can easily adjust the press for different garments and substrates. Also, because both the upper platen 66 and the lower platens 140, 150, 160, 180 can be easily rotated, the operator can easily imprint in portrait or landscape orientations. Lastly, because the press machine 10 uses a sliding arm assembly 25 that slides over a low profile chassis assembly 12 capable of being used with one or more workstation assemblies 75, 75', the operator is able to easily attach additional workstations to increase the presses' 10 imprinting capacity.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

We claim:

1. A lateral heat press machine, comprising;

a. a hollow elongated body with two longitudinally aligned rods located therein, said elongated body also including a longitudinally aligned slot;

b. a console assembly attached to said elongated body, said console assembly including a housing with a control panel located thereon and electrically connected to an external electrical power source;

c. at least one workstation assembly perpendicularly aligned to said elongated body thereby, said workstation assembly including a workstation pedestal with a lower base, forward extending strut member, and an upper platform;

d. a lower platen attached to said upper platform on said workstation pedestal;

e. a sliding arm assembly perpendicularly aligned with said elongated body, said sliding arm assembly includes a lower section and a upper section, said lower section being slidingly connected to said rods located inside said elongated body thereby enabling said sliding arm assembly to move longitudinally over said elongated body, said upper section extends above said elongated body and includes a vertically aligned neck with a moveable plunger located therein, said upper section having sufficient shape so that an upper platen attached to the distal end of said plunger is vertically aligned and registered over said lower platen attached to said workstation pedestal;

f. an upper platen attached to said plunger;

g. a handle coupled to said plunger enabling said plunger to be manually moved up and down inside said neck to force said upper platen against said lower platen; and, h. at least one heating element located in said upper platen, said heating element being electrically connected to said control panel on said console assembly.

2. The lateral heat press machine, as recited in claim 1, further including means for rotating said upper platen on said plunger.

3. The lateral heat press machine, as recited in claim 2, wherein said means for rotating said upper platen is a platen management plate attached to support platform on said upper platen that rotates over the lower end of said plunger.

4. The lateral heat press machine, as recited in claim 3, further including means for selectively fixing said platen management plate in a locked position on said plunger.

5. The lateral heat press machine, as recited in claim 1, further including a quick release mechanism disposed between said lower platen and said upper platform on said workstation pedestal.

6. The lateral heat press machine, as recited in claim 5, wherein said quick release mechanism includes a locking plate attached to workstation pedestal and a recessed cavity formed on the bottom surface of said lower platen, said quick release mechanism also including a locking pin attached to said locking plate and a hole formed on said lower platen.

7. The lateral heat press machine, as recited in claim 2, further including a quick release mechanism disposed between said lower platen and said upper platform on said workstation pedestal.

8. The lateral heat press machine, as recited in claim 7, wherein said quick release mechanism includes a locking plate attached to workstation assembly and a recessed cavity formed on the bottom surface of said lower platen, said quick release mechanism also including a locking pin attached to said locking plate and a hole formed on said lower platen.

9. The lateral heat press machine, as recited in claim 3, further including a quick release mechanism disposed between said lower platen and said upper platform on said workstation pedestal.

10. The lateral heat press machine, as recited in claim 9, wherein said quick release mechanism includes a locking plate attached to workstation assembly and a recessed cavity formed on the bottom surface of said lower platen, said quick release mechanism also including a locking pin attached to said workstation assembly and a hole formed on said lower platen.

11. The lateral heat press machine as recited in claim 1, further including a pressure/height adjustment mechanism located between said upper platform on said workstation pedestal and said lower platen.

12. The lateral heat press machine, as recited in claim 11, wherein said pressure/height adjustment mechanism includes an elevator bushing that horizontally supports said lower platen, said elevator bushing being attached to a threaded shaft connected to said upper platform and which, when turned, raises or lowers said lower platen on said upper platform.

13. The lateral heat press machine, as recited in claim 2, further including a pressure/height adjustment mechanism located between said upper platform on said workstation pedestal and said lower platen.

14. The lateral heat press machine, as recited in claim 11, wherein said pressure/height adjustment mechanism includes an elevator bushing that supports said lower platen, said elevator bushing being attached to a threaded shaft and which, when turn, raises to lowers said lower platen on said workstation pedestal.

15. The lateral heat press machine, as recited in claim 3, further including a pressure/height adjustment mechanism located between said upper platform on said workstation pedestal and said lower platen.

16. The lateral heat press machine, as recited in claim 15, wherein said pressure/height adjustment mechanism includes an elevator bushing that horizontally supports said lower platen, said elevator bushing being attached to a threaded shaft connected to said upper platen and which, when turned, raises or lowers said lower platen on said upper platform.

17. The lateral heat press machine, as recited in claim 7, further including a pressure/height adjustment mechanism located between said upper platform on said work station pedestal and said lower platen.

18. The lateral heat press machine, as recited in claim 17, wherein said pressure/height adjustment mechanism includes an elevator bushing that horizontally supports said lower platen, said elevator bushing being attached to a threaded shaft connected to said upper platen and which, when turned, raises or lowers said lower platen on said upper platform.

19. The lateral heat press machine, as recited in claim 1, further including a timer electrically connected to said control panel enabling an operator to monitor the length of pressing time during use.

20. The lateral heat press machine, as recited in claim 19, further including an automatic shut off switch coupled to said control panel that automatically turns off said heating element when a selected time period has elapsed.

21. The lateral heat press machine, as recited in claim 7, further including a timer electrically connected to said control panel enabling an operator to monitor the length of pressing time during use.

22. The lateral heat press machine, as recited in claim 21, further including an automatic shut off switch coupled to said control panel that automatically turns off said heating element when a selected time period has elapsed.

23. The lateral heat press machine, as recited in claim 22, wherein said lower platen is a flat rectangular structure.

24. The lateral heat press machine, as recited in claim 22, wherein said lower platen is a sleeve-style platen.

25. The lateral heat press machine, as recited in claim 22, wherein said lower platen is a hat-style platen.

26. The lateral heat press machine, as recited in claim 22, wherein said lower platen is a pocket-style platen.

27. The lateral heat press machine, as recited in claim 1, further including one or two laser alignment assemblies attached to said elongated body, said laser alignment assembly capable of providing a reference mark for accurately aligning a substrate over said lower platen.

28. The lateral heat press machine, as recited in claim 27, wherein said laser alignment assembly includes at least one vertical arm with an adjustable laser beam generating source capable of producing a combination of three laser beam reference lines or points on said lower platen.

* * * * *